US011655418B1

(12) United States Patent
Holcombe et al.

(10) Patent No.: US 11,655,418 B1
(45) Date of Patent: May 23, 2023

(54) ULTRA PURIFIED PITCH PROCESS

(71) Applicants: Thomas C Holcombe, Hillsborough, NJ (US); David C Boyer, Palm Coast, FL (US); Richard D Stone, New Orleans, LA (US)

(72) Inventors: Thomas C Holcombe, Hillsborough, NJ (US); David C Boyer, Palm Coast, FL (US); Richard D Stone, New Orleans, LA (US)

(73) Assignee: ACP TECHNOLOGIES, LLC, St. Clair Shores, MI (US)

( * ) Notice: Subject to any disclaimer, the term of this patent is extended or adjusted under 35 U.S.C. 154(b) by 0 days.

(21) Appl. No.: 17/389,071

(22) Filed: Jul. 29, 2021

Related U.S. Application Data

(60) Provisional application No. 62/706,141, filed on Aug. 3, 2020.

(51) Int. Cl.

| | |
|---|---|
| ***C10C 1/19*** | (2006.01) |
| ***C10C 3/06*** | (2006.01) |
| ***C10C 3/00*** | (2006.01) |

(52) U.S. Cl.
CPC ..... *C10C 3/06* (2013.01); *C10C 3/002* (2013.01)

(58) Field of Classification Search
CPC ..... C10C 1/19
See application file for complete search history.

(56) References Cited

U.S. PATENT DOCUMENTS

| | | | | |
|---|---|---|---|---|
| 9,222,027 | B1 * | 12/2015 | Malone | C10C 3/002 |
| 9,376,626 | B1 | 6/2016 | Malone et al. | |
| 10,731,084 | B1 * | 8/2020 | Malone | B01J 19/242 |

OTHER PUBLICATIONS

U.S. Appl. No. 17/731,923, filed Jul. 30, 2021, Boyer, et al.

* cited by examiner

*Primary Examiner* — Randy Boyer
(74) *Attorney, Agent, or Firm* — Richard D. Stone

(57) ABSTRACT

A process for producing isotropic and mesophase pitch with reduced solids contamination from aromatic liquids contaminated with solids, such as catalyst fines or semi-coke. Contaminated feed is charged through one or more pitch forming reactors which discharge a pitch rich liquid and a vapor phase with reduced solids contamination. The vapor phase is cooled, condensed and may be charged continuously to another pitch forming reactor in parallel or used intermittently as a total or partial replacement for solids contaminated feed.

19 Claims, 4 Drawing Sheets

ULTRA PURIFIED PITCH PROCESS

BACKGROUND OF THE INVENTION

Throughout history there has been a need for strong materials made from individual fibers with little strength. Use of such fibers to make rope and other articles was an important development in early civilization. Rope making occurred before the wheel was invented. In ancient Egypt, reed fiber was the primary source, but flax, grass, papyrus, fibers from date palms, animal hair or even leather strips were also used. Rope was made of multiple strands braided or twisted together. Although the individual fibers or strands had relatively low strength, the resulting rope would not break even if an individual strand were to fail. Multiple weak fibers could form strong rope or other material, but there was always an interest in using stronger fibers to make a rope or material which was both stronger and lighter in weight.

Centuries later, an unusual fiber was developed by Edison in 1879 as part of the development of the electric light bulb. Edison heated cotton threads to carbonize them. These carbonized threads were used as filaments for the first light bulbs. Although most light bulbs eventually used tungsten filaments, carbon filaments were used where their special structural properties were important. US Navy ships used carbon filament light bulbs as late as 1960, because the carbon filament withstood vibration better than other filament materials. Early carbon fibers had little strength in tension so their use was generally limited to light bulbs.

The potential use of carbon fibers for other materials than bulbs was not appreciated until Roger Bacon, an American physicist, produced carbon fibers in 1958 while working to discover the triple point of carbon, the conditions at which all three phases coexisted. During his experiments, Bacon made carbon fibers, up to 1 inch long, with extraordinary properties. His fibers had a high tensile strength, 20 Gigapascals (GPa) and Young's modulus of 700 GPa. Tensile strength measures pulling force to break a fiber, Young's modulus measures stiffness, or ability to resist elongation under load. Bacon's carbon fibers were far stronger than steel, on a weight basis. Bacon's incidental discovery began a modern fiber race—a race to develop ever stronger fibers which were affordable. Carbon fibers are now widely used in manufacture of airplanes, disc brakes and many consumer products where its high strength and lower weight make them the preferred material.

Carbon fibers can be made from many materials ranging from Edison's cotton threads to rayon. Most carbon fibers today are made from Poly Acrylonitrile (PAN). Fibers also can be made from isotropic or mesophase pitch. Modern, high performance carbon fibers can be made which exhibit graphitic crystalline structure or a turbostratic structure. In the latter structure, parallel graphene sheets are stacked irregularly or are haphazardly folded, tilted, or split. Crystalline structure can only be observed in vapor-grown carbon filaments or in carbon fibers derived from mesophase pitch. Vapor-grown fibers have excellent properties, but at present the cost of making these fibers precludes widespread use. Fibers made from mesophase pitch also exhibit crystalline structure and have excellent properties, but fibers made from mesophase pitch can be produced at lower cost than vapor-grown fibers.

We investigated the state of the art of producing mesophase fibers and the factors which influenced the properties of strength and specific modulus in said fibers. A search of the literature on mesophase formation showed that particulates have a profound impact on mesophase formation and fiber properties. Small particles can interfere with the complex mechanism by which mesophase is formed from isotropic pitch. Even more significant, the particles which end up in the fibers are a "weak link" in the resulting fiber, creating a spot which can break on flexing or in tension.

When a fluidized catalytic cracking unit is the source of the feed the particulate contamination is usually very small catalyst particles which escaped with cracked product vapors into the FCC main column. The particles end up in the bottom of the column producing an aromatic rich and significantly contaminated heavy oil product sometimes called "slurry oil" due to the particulate contamination. Refiners try to avoid some of the contamination by letting the slurry oil settle in a tank to allow some of the catalyst fines to settle to the bottom of the tank, producing a clarified slurry oil (CSO). CSO has a greatly reduced fines content but still contains some particulates, enough to contaminate any mesophase product with catalyst fines.

Coal tar may be used to make mesophase pitch and carbon fiber. Coal tar is usually contaminated with significant amounts of coke fines. The fines are usually coal-derived solids (coal, coke, cenospheres) and by-product-derived solids (carbon blacks, pyrolysis blacks). Coal-derived contaminants, in addition, contain the inherent mineral matter associated with the feed coal to the coke ovens.

Another possible source of particulates in coal tar or wood tar is "semi-coke" produced as an unwanted product during coking. Regardless of the source, solids contaminated coal tar is difficult to filter and centrifuge treatment achieves only limited success.

Mesophase pitch is a preferred raw material for manufacture of carbon fiber, especially as lower cost processes have been developed for mesophase pitch production. https://www.compositesworld.com/news/coming-to-carbon-fiber-low-cost-mesophase-pitch-precursor. This new process, and most processes for making mesophase pitch, start with slurry oil or clarified slurry oil. Even with feed filtration, some catalyst fines remain in an amount sufficient to impact the properties of the mesophase pitch and the carbon articles made from the pitch. Carbon fibers typically have diameters in the range of 8-10 microns. Thus, when spinning carbon fiber from isotropic or mesophase pitch, solid particles that are 2-3 microns in diameter or larger can represent major flaws in the spun fibers, causing the fibers to break or significantly reducing the carbon fibers' strength. Larger solid particles can even plug the spinneret holes, cutting off flow altogether. Thus, if pitch is to be used for carbon fiber production, it is extremely important that even very small solid particles be removed to very low concentration. In the past, solids in pitch and pitch precursors were removed by centrifugation or severe filtration. These processes add significantly to the cost of the process.

We wanted a process which greatly reduced the amount of particulates in mesophase pitch and did so at a reasonable cost. In general, pitch processes start with an aromatic liquid feed that is partially converted to mesophase pitch in a reactor. Unconverted feed is removed, after vapor and liquid separation, as an overhead vapor. The solid contaminants in the feed oil predominantly remain in the liquid mesophase pitch product. The overhead vapors, which contain 2-3 ring and heavier aromatics, are obtained as a vapor phase and have a greatly reduced, even essentially eliminated, solids content. These 2-3 ring and heavier aromatics can be recovered as a pure vapor from the pitch liquid residue fraction.

The vaporized hydrocarbons are clean while the catalyst fines or semi-coke, cannot vaporize and remain in the liquid phase.

The vapors are often condensed and pumped back to mix with the incoming feed in pitch processes. The essentially solids free recycle material is mixed with the solids contaminated feed. The mesophase pitch liquid product contains essentially all of the solids in the feeds. When an isotropic pitch product is sought, the problems are similar in that any solids in the liquid aromatic feed end up in the isotropic pitch product.

We discovered a way to greatly reduce, indeed reduce to any desired level, the solids contamination in an isotropic or mesophase pitch product. We produce a vaporization purified feed at low cost, by using an existing plant process which produces such purified vapors.

BRIEF SUMMARY OF THE INVENTION

Accordingly, the present invention provides a process for producing a reduced contaminant content pitch product from a contaminated multi-ring aromatic liquid fresh feed containing solid contaminants comprising charging said contaminated fresh feed comprising multi-ring aromatics to a pitch forming reactor operating at pitch forming reaction conditions including a pitch forming temperature and pressure and converting said contaminated feed into at least one of isotropic pitch and mesophase pitch and unconverted or partially converted contaminated feed, discharging from said reactor a reactor effluent comprising a two phase mixture of liquid pitch and a vapor phase comprising unconverted and partially converted feed into a vapor liquid separation means, separating said two phase mixture in said vapor liquid separation means into a pitch rich liquid phase with an increased contaminant content relative to said contaminated feed and a vaporization purified vapor phase fraction with a reduced or eliminated contaminant content, cooling, condensing and recovering at least a portion of said vaporization purified vapor phase fraction as a vaporization purified multi-ring aromatic intermediate product, at least periodically charging said vaporization purified intermediate to a pitch forming reactor and converting therein at least a portion of said purified intermediate to an ultra-purified isotropic or mesophase pitch with a reduced solids content as compared to said contaminated feed, and recovering said ultra-purified isotropic or mesophase pitch as a product of the process.

In another embodiment, the present invention provides a process for simultaneously and continuously producing a solids contaminated pitch product and a reduced contaminant content pitch product from a contaminated multi-ring aromatic liquid fresh feed containing solid particulates comprising charging said contaminated fresh feed comprising multi-ring aromatics to a pitch forming primary reactor operating at pitch forming reaction conditions including a pitch forming temperature and pressure and converting said contaminated feed into a solids contaminated liquid phase comprising at least one of isotropic pitch and mesophase pitch and a vapor phase comprising unconverted or partially converted contaminated feed, discharging from said primary reactor a reactor effluent comprising a two phase mixture of said solids contaminated liquid phase and said vapor phase into a primary vapor liquid separation means, separating said two phase mixture in said primary vapor liquid separation means to produce a pitch rich liquid phase with an increased solids contaminant content relative to said contaminated fresh feed and a vapor fraction comprising unconverted or partially converted feed vapors with a reduced or virtually eliminated solids contaminant content, cooling and condensing said vapors with a reduced or virtually eliminated solids content in a primary vapor liquid separator to produce a vaporization purified unconverted or partially converted feed intermediate liquid product, charging said vaporization purified intermediate liquid product to a secondary reactor operating at pitch forming reaction conditions including a pitch forming temperature and pressure and converting therein said vaporization purified intermediate liquid product into a two phase mixture comprising at least one of isotropic pitch and mesophase pitch and a vapor phase, discharging from said secondary reactor said two phase mixture into a secondary vapor liquid separation means, and recovering as a product of the process from said secondary vapor liquid separation means a liquid pitch product having a reduced solids content as compared to said solids contaminated fresh feed and to said pitch recovered from said primary reactor separation means.

DETAILED DESCRIPTION OF PREFERRED EMBODIMENTS

Figure 1:
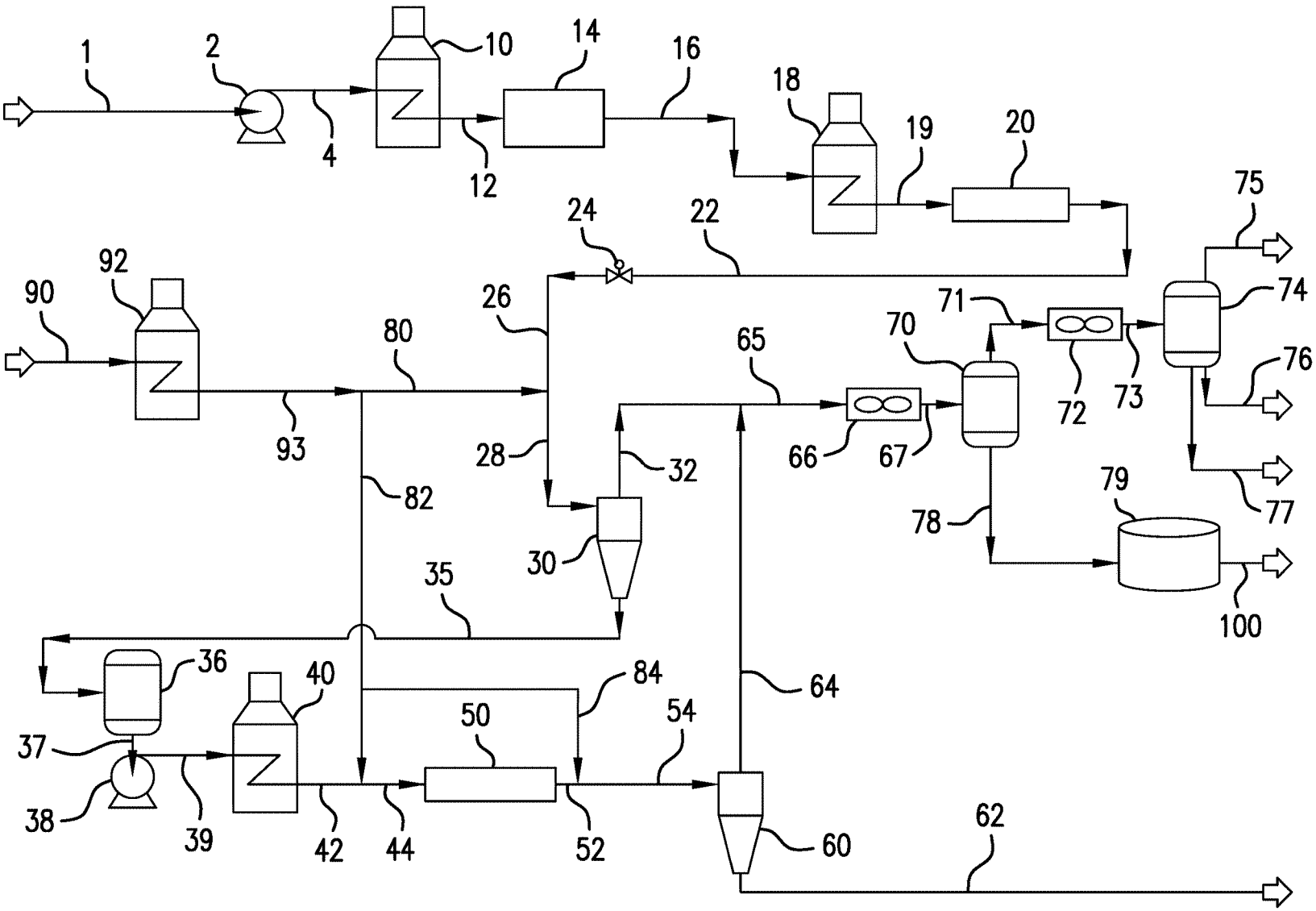
FIG. 1 is a process flow diagram for a closely coupled isotropic and mesophase pitch process of the present invention in blocked or cyclic operation.

Referring to FIG. 1, a clarified slurry oil feed in line 1, recovered from the bottom of the main column associated with an FCC unit not shown, is charged via pump 2 and line 4 into preheater heater 10. Preheated feed is charged via line 12 into preferred but optional filter 14 and then via line 16, heater 18 and line 19 into reactor 20, shown as a black box. Reactor effluent is discharged via line 22 across pressure reducing valve means 24 and line 26, mixed with preferred but optional steam or other superheated fluid added via line 80 and the resulting mixture charged via line 28 into cyclone separator 30. An isotropic pitch rich product is withdrawn as a liquid fraction via line 35 and may be recovered as a product by means not shown or charged to tank 36. Isotropic pitch is withdrawn from tank 36 via line 37 and pump 38 and discharged via line 39 to pass through heater 40 and line 42 to mix with steam or other superheated fluid in line 82 to form a mixture passed via line 44 into mesophase forming reactor 50. Preferably a significant amount of the heat input required for the feed to the mesophase forming reactor 50 is supplied by the addition of superheated fluid, reducing the amount of heat which must be added via heater 40. Reactor effluent is discharged via line 52 and mixed with preferred but optional superheated fluid added via line 84 and the resulting mixture discharged via line 54 into cyclone separator 60. Overhead vapor from separator 60 is withdrawn via line 64, preferably joins overhead vapor in line 32 from cyclone 30 and charged via line 65 to cooler 66. Cooled vapors are charged via line 67 into separator 70, running at conditions which keep any water and light hydrocarbons present in the vapor phase, which are removed overhead via line 71. Condensed hydrocarbon liquid in separator 70 is withdrawn via line 78 and stored in tank 79. The overhead vapors in line 71 are cooled in cooler 72 and discharged via line 73 into vapor liquid separator 74. A fuel gas stream is withdrawn from this separator via line 75 while a light distillate stream is recovered via line 77 and water recovered via line 76. Mesophase rich pitch product is withdrawn via line 62 from cyclone 60. Water, or other fluid to be superheated is charged via line 90 to heater 92 producing superheated fluid in line 93 which can be charged to the first reactor effluent via line 80 or the charged to the second reactor via line 82 or the second reactor effluent via line 84.

In this embodiment of our invention, the process runs in blocked or cycling operation. The fresh feed, when taken from an FCC unit or other industrial source, will contain particulates such as catalyst fines. These can be removed to some extent by heated filtration in filter 14, but there will still be troublesome amounts of solid contaminates. The mesophase pitch, and the isotropic pitch if produced, will have significant solids contamination, indeed the solids contamination will be higher in the product than in the feed because the solids end up in the liquid phase while the vapor phases have greatly reduced, or eliminated solids content. To make an ultra-pure pitch product, we accumulate the overhead vapors produced in both the first and the second reactors and cool and collect them in storage tank 79. After a pre-determined period, which can be days or weeks, and when a purer pitch product is required, the liquid in storage tank 79 is withdrawn via line 100 and charged to feed line 1 by means not shown. When ultra-pure pitch product is required all the feed in line 1 will be taken from storage tank 79. If some, or an increased level of, contaminants can be tolerated in the feed or if the process works better because of alkyl substituents in the FCC feed cycle oil, then a mixture of fresh feed from an FCC unit and vapor purified heavy distillate in line 100 may be used.

Figure 2:
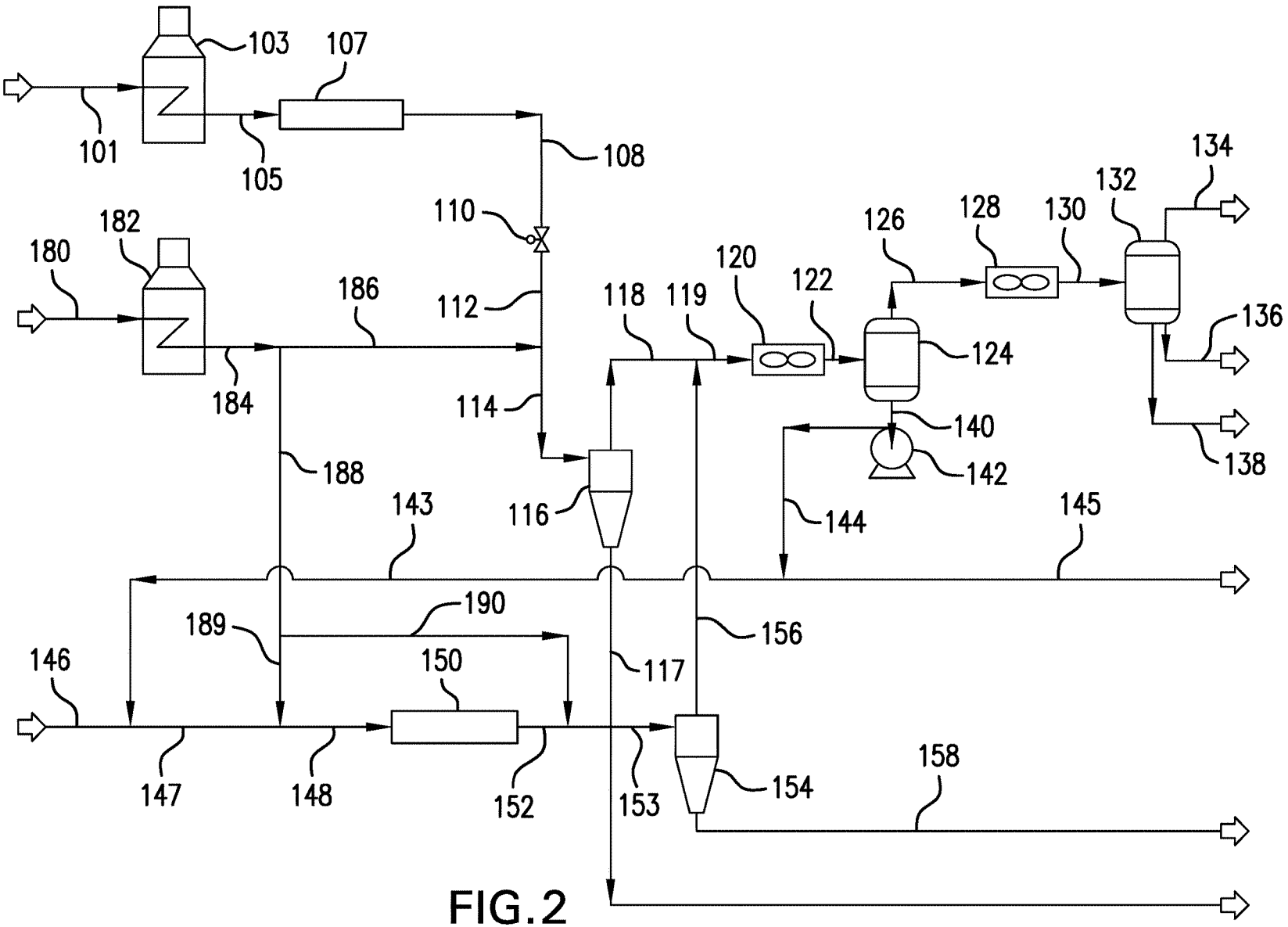
FIG. 2 shows a continuous process flow diagram for a plant making ultra-pure isotropic pitch and, as a by-product, isotropic pitch contaminated with solids.

FIG. 2 shows a process for continuously making ultra-pure isotropic pitch and some solids contaminated isotropic pitch as a byproduct. Much conventional equipment is not shown, such as pumps and coolers, but those skilled in the pitch arts will understand the simplified process flow. Fresh feed, typically an FCC slurry oil, is charged via line 101 and pumps, optional filters and the like not shown, to heater 103 and discharged via line 105 into isotropic pitch forming reactor 107 also called the primary reactor. Reactor effluent is discharged via line 108 and passed through pressure reducing valve 110. The reduced pressure reactor effluent passes through line 112 and is mixed with superheated vapor, preferably steam, in line 186 and the resulting mixture charged via line 114 into cyclone separator 116. The reactor effluent vapors and the added superheated fluid are recovered overhead via line 118, mixed with vapors in line 156 and charged via line 119 to cooler 120 and line 122 into vapor liquid separator 124. The vapor phase is removed overhead via line 126 through cooler 128 and via line 130 into separator 132. A fuel gas stream is removed overhead via line 134 while light distillate is removed as a bottoms stream via line 138. When the superheated fluid added via line 186 is water the condensed water is removed from separator 132 via line 136. The liquid phase removed from separator 116 is removed via line 117 as an isotropic pitch product which contain most, usually essentially all, of the solids in the feed in line 101. Although this isotropic pitch contains solids, it has much value for many applications.

Ultra-purified isotropic pitch is made by taking the heavy distillate phase liquid from separator 124 via line 140 and pump 142 and sent via line 144, 143 and 147, optionally mixed with alkylated aromatic feed in line 146, preferably mixed with superheated fluid from line 189 and the resulting mixture in line 148 charged to isotropic pitch reactor 150 also known as the secondary reactor. An isotropic rich pitch stream is discharged from this reactor via lines 152 and 153 into cyclone 154 or any other type of vapor liquid separator. An ultra-purified isotropic pitch product is withdrawn from this cyclone or separator via line 158 and recovered as a product of the process. Overhead vapors from separator 154 are removed via line 156 and mixed with overhead vapors derived from the primary isotropic pitch reactor and the combined vapors processed through the cooler and separator 124 as discussed above. If desired a vaporization purified heavy distillate byproduct may be recovered as a separate product via line 145, though preferably much or all of this heavy distillate is charged to the secondary reactor 150.

Boiler feed water, or other fluid which is inert under these conditions, is charged via line 180 to heater 182 producing superheated fluid in line 184. This superheated fluid may be charged via line 186 to mix with primary reactor effluent, line 188 and 189 to the inlet of the secondary reactor or via line 188 and 190 to the secondary reactor effluent.

The primary reactor achieves some conversion of aromatic liquid feed to isotropic pitch. This pitch may then be separated in separator 116 to produce a solids contaminated liquid phase and a reduced solids content vapor in line 118. Careful cooling and condensation of this vapor can recover a heavy distillate fraction with a reduced solids content which makes an ideal charge stock to the secondary reactor. The process shown in FIG. 2 preferably operates continuously, always producing some ultra-purified isotropic pitch and, as a byproduct, some solids contaminated isotropic pitch.

Figure 3:
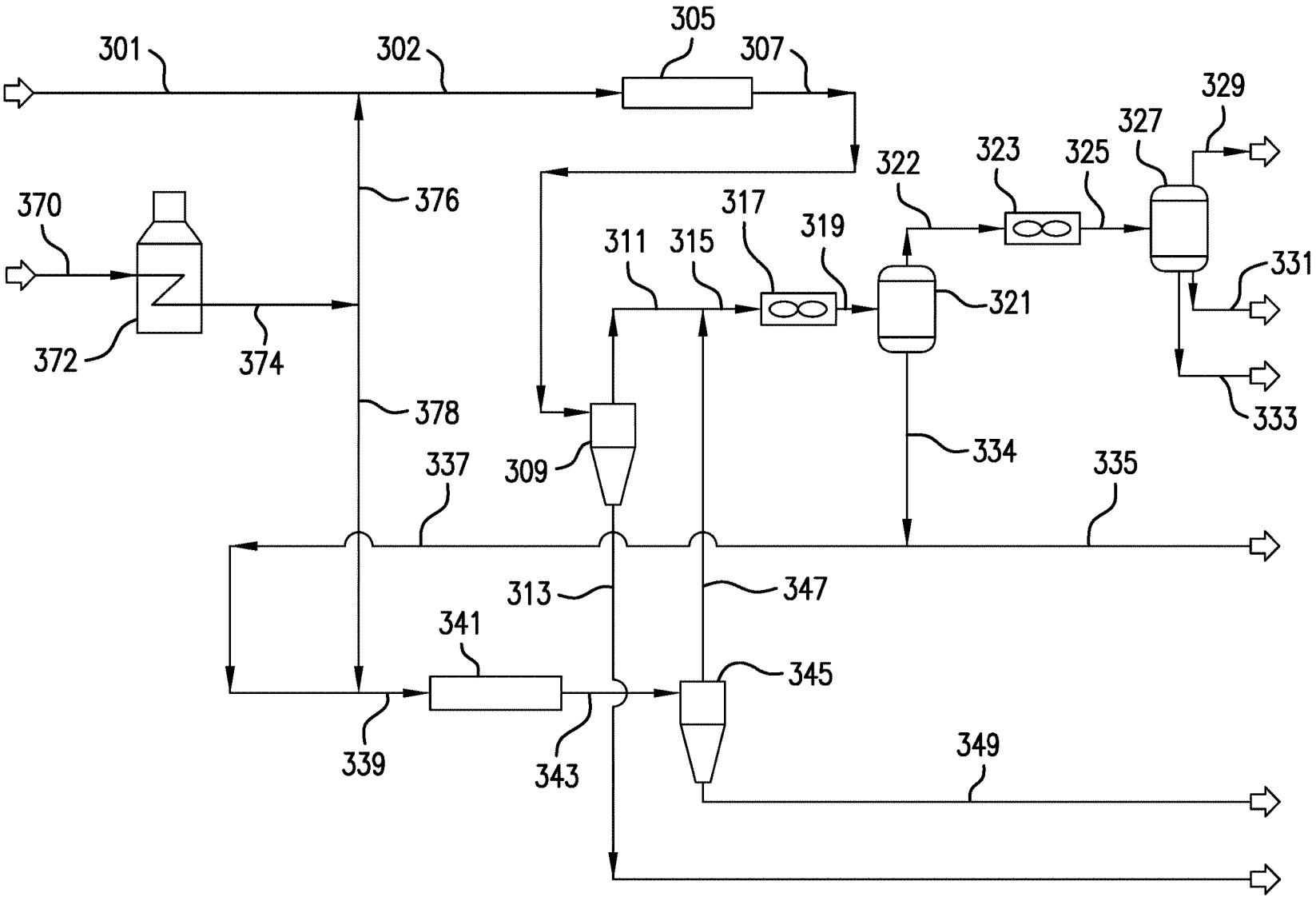
FIG. 3 shows a continuous process for making an ultra-pure mesophase pitch product and as a byproduct mesophase pitch with solids contamination.

FIG. 3 shows a continuous process for making both ultra-pure mesophase pitch product and a byproduct mesophase pitch with solids contamination. An isotropic pitch feed, contaminated with modest or significant amounts of solids such as FCC catalyst fines, is charged via line 301 through preferred but optional pumps, preheaters and filters not shown and preferably mixed with a superheated fluid from line 376 and the resulting mixture charged via line 302 to primary mesophase forming reactor 305. Both the primary and the secondary reactor, to be discussed hereafter, form mesophase and the designation primary and secondary refers more to their placement in the process than any difference in reaction conditions or performance. Primary reactor effluent passes via line 307 into separator 309, which is preferably a cyclone separator or other type of vapor liquid separator. A mesophase pitch rich fraction is withdrawn from the bottom of separation means 309 via line 313 for recovery as a product of the process. This fraction can have many uses, but it will have most, or essentially all of the solids in the isotropic pitch feed as the solids remain in the liquid phase. A vapor phase is removed overhead from separator 309 via line 311 and charged via line 315 into cooler 317 and into vapor liquid separator 321 via line 319. The separator is run at a temperature and pressure which condenses a majority of the multi-ring aromatics present but keeps water vapor, normally gaseous hydrocarbons and light distillate in the vapor phase. A liquid phase, comprising heavy distillate hydrocarbons is withdrawn from separator 321 via line 334 and 335 for recovery as a heavy distillate byproduct, if desired. Preferably most, or more preferably all, of the liquid withdrawn from separator 321 is fed to the secondary mesophase forming reactor 341 via lines 334, 337 and 339. The vapor phase from separator 321 is withdrawn overhead via line 322 and cooled in cooling means 323 which discharges via line 325 into vapor/liquid separator 327. This separator is run at a temperature and pressure which condenses water and light distillate. A normally gaseous vapor phase is withdrawn overhead via line 329 for use as a fuel gas or for other treatment, while water is removed via line 331. A light distillate hydrocarbon fraction is recovered as a liquid in line 333 which may be burned as fuel or used as a blending agent in fuel or solvents or for other refinery purposes.

The heavy distillate fraction recovered from separator 321 has a greatly reduced or eliminated solids contaminant content. This material is converted in secondary mesophase forming reactor 341, at least in part, to ultra-purified mesophase pitch. This reactor discharges via line 343 into vapor liquid separation means 345 such as a cyclone separator. An ultra-purified mesophase pitch product is withdrawn via line 349 as a product of the process. Our preferred mesophase forming reactor achieves significant mesophase formation, but leaves significant amounts of heavy distillate feed which was partially converted in reactor 341. The unconverted feed from secondary pitch forming reactor 341 is recovered as an overhead vapor phase from separator 345 and charged via line 347 to mix with overhead vapor in line 311 from the primary mesophase pitch forming reactor 305. We prefer to commingle the vapor phases from both the primary and secondary mesophase forming reactors as they are very similar in composition and properties and may easily be processed as a combined vapor stream.

Superheated fluid, preferably superheated steam, may beneficially be added to several parts of the process. Boiler feed water in line 370 is superheated in heater 372 to form superheated fluid in line 374. This superheated fluid is charged via line 376 to mix with feed to the primary mesophase pitch forming reactor 305 or via line 378 to mix with the feed to the secondary mesophase pitch forming reactor 341.

Figure 4:
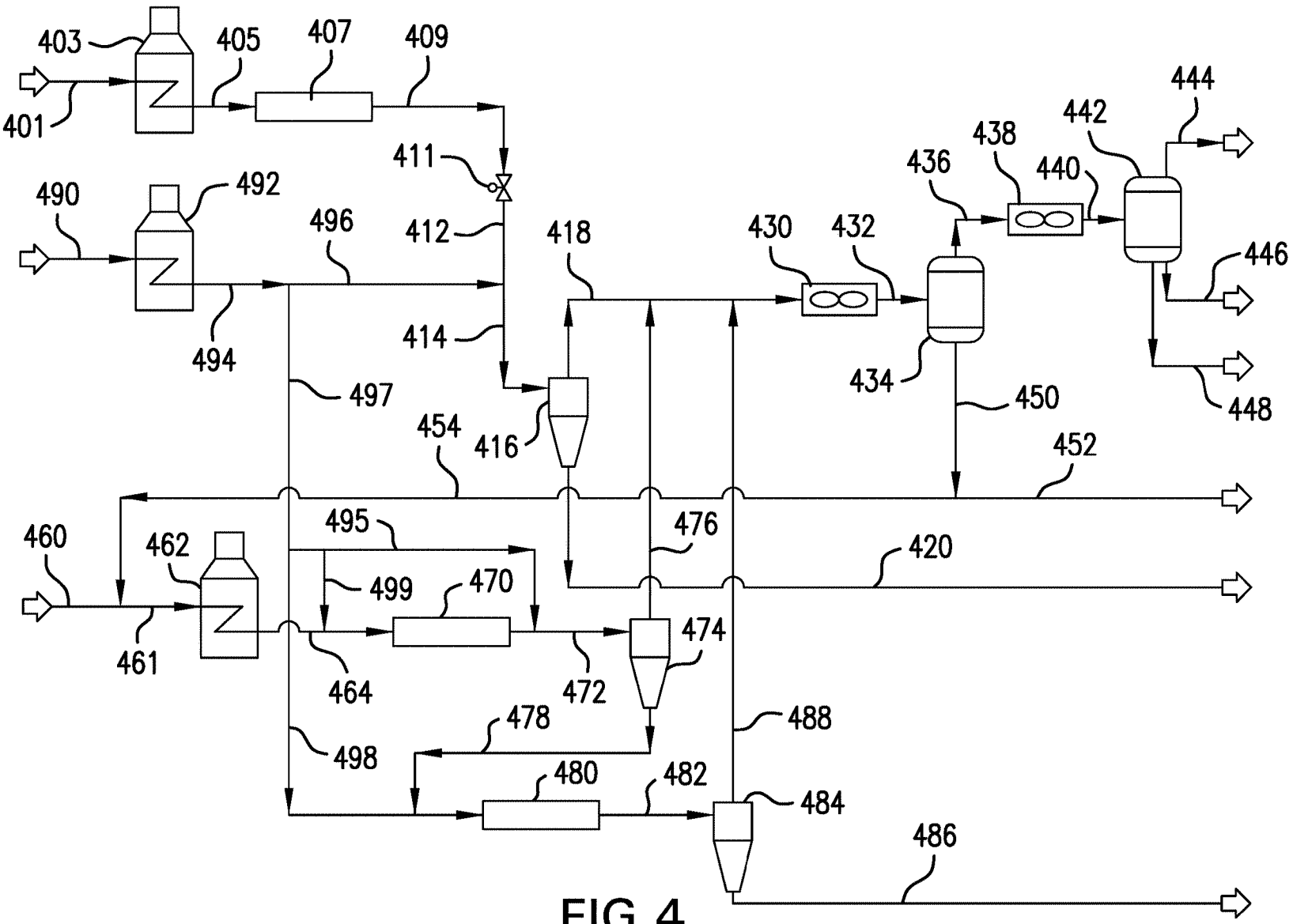
FIG. 4 shows a continuous process for making ultra-pure mesophase pitch and an isotropic pitch contaminated with solids.

FIG. 4 shows a continuous process for making ultra-purified mesophase pitch and an isotropic pitch contaminated with solids. A multi-ring aromatic hydrocarbon feed such as an FCC slurry oil contaminated with catalyst fines is charged via line 401 to heater 403 and discharged via line 405 into isotropic pitch reactor 407 where significant conversion of multi-ring aromatics to isotropic pitch occurs. Reactor effluent passes via line 409 through pressure reducing means 411 and lines 412 and 414 into vapor liquid separation means 416 such as a cyclone or other type of vapor liquid separator. Unconverted, or partially converted feed is withdrawn as a vapor via line 418, along with any steam or other superheated fluid added and lighter products produced in the isotropic pitch forming reactor 407. A liquid phase comprising isotropic pitch is withdrawn from separator 416 via line 420. This isotropic pitch contains a majority, preferably at least 90% and ideally essentially all of the solids in the feed in line 401. Although contaminated with solids this isotropic pitch fraction has considerable value for many industrial uses, such as binder pitch for the aluminum industry, driveway sealers, and diluted with solvent to tar and feather politicians.

The vapor phase recovered from separator 416 is charged via line 418 to cooler 430 with cooled vapors discharged via line 432 into vapor and liquid separation means 434. Temperature and pressure therein are set to condense at least a majority of heavy distillate material, typically 2 and 3 ring aromatic hydrocarbons. The vapor phase removed from separator 434 is charged via line 436 to cooler 438 and discharged via line 440 into vapor and liquid separator 442. Temperature and pressure are set to condense at least a majority of light distillate hydrocarbons, recovered as a liquid via line 448. Water condensate is removed via line 446 while a vapor phase comprising normally gaseous hydrocarbons is withdrawn overhead via line 444.

The heavy distillate liquid recovered from separator 434 is rich in multi-ring aromatic hydrocarbons and has a greatly reduced or eliminated solids content. A portion of this material may be recovered, if desired, as a reduced solids aromatic liquid hydrocarbon product via line 450 and 452, but preferably most or all of the liquid removed from the separator is charged to the isotropic pitch forming reactor 470 via lines 450 and 454. If desired, a small portion of fresh feed, even feed contaminated with solids, may be added via line 460 when some solids can be tolerated in the pitch products or when required to ensure that sufficient alkyl groups are present on the aromatic rings charged to the isotropic pitch forming reactor. Other low-solids or solids free alkyl aromatics may be added, as removal of an alkyl group from an aromatic ring creates a reactive molecule which is believed to foster pitch formation. The heavy distillate, alone or mixed with additional alkyl aromatics in line 460, is charged to heater 462 via line 461 and discharged into isotropic pitch forming reactor 470 via line 464.

Reactor 470 effluent is discharged via line 472 into separator 474, preferably a cyclone separator. A vapor phase is withdrawn via line 476 and mixed with vapor from separator 416. A liquid phase is withdrawn via line 478, mixed with optional superheated fluid in line 498 and charged to mesophase forming reactor 480. Reactor effluent is discharged via line 482 into vapor liquid separator 484, preferably a cyclone separator. An overhead vapor stream comprising unconverted multi ring aromatic hydrocarbons and lighter materials formed in the reactor is removed via line 488 to mix with overhead vapor from the first separator 416. An ultra-purified mesophase pitch product is recovered from separator 484 via line 486 as a product of the process. Superheated fluid, preferably superheated steam may beneficially be added to multiple parts of the process. Boiler feed water in line 490 is heated in heater 492 to form superheated fluid in line 494 which can be charged via line 496 to mix with first reactor effluent, via line 497 and 499 to the inlet of the second reactor, via line 497 and 495 to the effluent from the second reactor 470, or via line 497 and 498 to mix with the charge to the mesophase forming reactor 480.

Pitch Process

The process of the invention may be used for production of purer isotropic pitch or purer mesophase pitch or both. The process works especially well when the reactor effluent vapor phase from a mesophase forming reactor is recovered and charged to an isotropic pitch reactor. This is because the vapor phase recovered from mesophase formation has a high molecular weight, indeed much of this vapor is partially polymerized multi-ring aromatics, and is well suited as a feed to the isotropic pitch reactor.

The feeds and reaction conditions in a pitch forming reactor may be conventional. Our preferred isotropic pitch forming process is disclosed in U.S. Pat. No. 9,222,027. Our preferred mesophase pitch forming process is disclosed in U.S. Pat. No. 9,376,626. These patents are incorporated by reference. Many other pitch processes have been developed and may be used as well.

Our preferred method of making isotropic pitch is to use a tubular reactor, operating at 800-1000° F., 800-2000 psi inlet pressure, one to 20 minutes residence time, 1-20 ft/sec average velocity and 30-80 vol % vapor (avg)

We prefer to make mesophase pitch in a tubular reactor operating at 750-900° F., 30-100 psi inlet pressure, 200-1000 ft/sec velocity (avg) and 99.9+vol % vapor.

Feed Filtration

Feed filtration is practiced now to some extent both on the 2 and 3 ring and heavier feed. Using our process, we can avoid, or at least use much less filtration by using recycled vaporization purified feed mixed with filtered fresh feed. If ultra high purity is required in the pitch product then little or no fresh feed should be added.

Alkyl Groups

When it is desired to use isotropic pitch as a precursor for the production of mesophase pitch, producing isotropic pitch with fewer alkyl groups on the multi-ring aromatics may be advantageous. This is because alkyl groups can cause steric hindrance when the multi-ring aromatic molecules self-assemble into spherical crystal clusters to form mesophase pitch. Isotropic pitch with few alkyl groups will self-assemble to form mesophase pitch faster and reach higher mesophase contents under less severe reactor conditions. Most isotropic pitch forming reactors cause a significant amount of dealkylation of the multi-ring aromatic molecules in the feedstock. As a result, a vaporization purified multi-ring aromatic intermediate product recovered from a first isotropic pitch forming reactor has a significantly lower concentration of alkyl groups than the original feedstock. It should be noted that the same effect would be true if the feed contained no solids and purification is not necessary. When this intermediate product is fed to a second isotropic pitch forming reactor, it will thereby produce isotropic pitch with significantly fewer alkyl groups in the isotropic pitch product. The unreacted multi-ring aromatics recovered from the second isotropic pitch will contain an even lower concentration of alkyl groups and, if recycled, to the second reactor feed, will reduce the alkyl group concentration of the isotropic pitch product even further. When producing a low alkyl group isotropic pitch product, the reaction rate may be improved by adding a solids free low-boiling alkylated aromatic compound such as toluene or methyl naphthalene to the feed to the second isotropic pitch forming reactor since one of the pitch forming reactions is dealkylation of an aromatic ring to form a reactive site which subsequently reacts with another multi-aromatic ring molecule to form a larger multi-aromatic ring molecule. Unreacted low-boiling alkylated aromatic compounds are preferred because they can be easily recovered from the isotropic pitch using their low boiling points. If extreme purity isotropic pitch product is not required, a small amount of contaminated fresh feed could be added to the feed to the second reactor instead of solids free low-boiling alkylated aromatic compounds.

Vapor Liquid Separator Conditions

An important factor in running the process is flash conditions. The amount and composition of the heavy distillate recovered in the vapor liquid separators downstream of the pitch forming reactors will depend upon the temperature, pressure and amount of superheated stripping gas used. The total amount of heavy distillate, as well as the average molecular weight of the heavy distillate, is generally increased by increasing the flashing temperature, reducing the pressure and increasing the amount of stripping gas used. In general, reactor effluent, or a heated fresh feed, is flashed at relatively low pressures, theoretically possible but difficult 0.1 to 10 atm, preferably 1 to 5 atm and most preferably 20 to 50 psia. Temperature in the flash separators is usually high, from 500 to 1100° F., preferably from 600 to 1000° F. and ideally 750 to 850° F. The stripping gas to hydrocarbon weight ratio is usually from 0.1 to 9.0, preferably from 0.3 to 3.0 and ideally 0.5 to 1.5.

Steam Addition

Steam, or other superheated fluid may beneficially be added to multiple points of the process. To clarify, any fluid which is generally inert at the conditions used may be superheated and used herein, but steam is preferred. Steam may also clean the tubular, or other, reactors out to some extent by reacting with, or preventing formation of, coke deposits with the reactor. Steam also performs other important functions such as ensuring turbulent flow in the mesophase pitch forming reactor and steam stripping of any heavy hydrocarbon liquid. Steam stripping has historically been used to extract the essence of herbs and flowers, but it is also effective at vaporizing and removing 2 and 3 ring aromatic hydrocarbons from an isotropic or mesophase pitch liquid fraction.

We claim:

1. A process for producing a reduced contaminant content pitch product from a contaminated multi-ring aromatic liquid fresh feed containing solid contaminants comprising:

a) Charging said contaminated fresh feed comprising multi-ring aromatics to a pitch forming reactor operating at pitch forming reaction conditions including a pitch forming temperature and pressure and converting said contaminated feed into at least one of isotropic pitch and mesophase pitch and unconverted or partially converted contaminated feed, b) Discharging from said reactor a reactor effluent comprising a two phase mixture of liquid pitch and a vapor phase comprising unconverted and partially converted feed into a vapor liquid separation means, c) Separating said two phase mixture in said vapor liquid separation means into a pitch rich liquid phase with an increased contaminant content relative to said contaminated feed and a vaporization purified vapor phase fraction with a reduced or eliminated contaminant content d) Cooling, condensing, and recovering at least a portion of said vaporization purified vapor phase fraction as a vaporization purified multi-ring aromatic intermediate product and e) At least periodically charging said vaporization purified intermediate to a pitch forming reactor and converting therein at least a portion of said purified intermediate to an ultra-purified isotropic or mesophase pitch with a reduced solids content as compared to said contaminated feed, and f) Recovering said ultra-purified isotropic or mesophase pitch as a product of the process.

2. The process of claim 1 wherein said pitch-forming reactor being charged with said contaminated feed is an isotropic pitch forming reactor comprising a tubular reactor operating at thermal polymerization conditions including a temperature above 600° F. and pressure above 500 psia.

3. The process of claim 1 wherein said pitch-forming reactor being charged with said contaminated feed is a mesophase pitch forming reactor comprising a tubular reactor operating at mesophase formation conditions including a temperature above 600° F. and pressure below 500 psia.

4. The process of claim 1 wherein at least a portion of said contaminated feed is a slurry oil or clarified slurry oil from a fluidized catalytic cracking process.

5. The process of claim 1 wherein at least a portion of said contaminated feed is an ethylene cracker bottoms product.

6. The process of claim 1 wherein at least a portion of said contaminated feed is selected from the group of coal tar and wood tar.

7. The process of claim 1 wherein during periodic operation with vaporization purified feed 100% of feed to said reactor is vaporization purified.

8. The process of claim 1 wherein during periodic operation with vaporization purified feed from 5 to 50 wt % of total feed is contaminated and from 95 to 50 wt % of total feed is vaporization purified.

9. The process of claim 1 wherein said reduced contamination pitch product has a solids content of 100 wt ppm.

10. A process for simultaneously and continuously producing a solids contaminated pitch product and a reduced contaminant content pitch product from a contaminated multi-ring aromatic liquid fresh feed containing solid particulates comprising:

a) Charging said contaminated fresh feed comprising multi-ring aromatics to a pitch forming primary reactor operating at pitch forming reaction conditions including a pitch forming temperature and pressure and converting said contaminated feed into a solids contaminated liquid phase comprising at least one of isotropic pitch and mesophase pitch and a vapor phase comprising unconverted or partially converted contaminated feed, b) Discharging from said primary reactor a reactor effluent comprising a two phase mixture of said solids contaminated liquid phase and said vapor phase into a primary vapor liquid separation means, c) Separating said two phase mixture in said primary vapor liquid separation means to produce a pitch rich liquid phase with an increased solids contaminant content relative to said contaminated fresh feed and a vapor fraction comprising unconverted or partially converted feed vapors with a reduced or virtually eliminated solids contaminant content, d) Cooling and condensing said vapors with a reduced or virtually eliminated solids content in a primary vapor liquid separator to produce a vaporization purified unconverted or partially converted feed intermediate liquid product, e) Charging said vaporization purified intermediate liquid product to a secondary reactor operating at pitch forming reaction conditions including a pitch forming temperature and pressure and converting therein said vaporization purified intermediate liquid product into a two phase mixture comprising at least one of isotropic pitch and mesophase pitch and a vapor phase, f) Discharging from said secondary reactor said two phase mixture into a secondary vapor liquid separation means, and g) Recovering as a product of the process from said secondary vapor liquid separation means a liquid pitch product having a reduced solids content as compared to said solids contaminated fresh feed and to said pitch recovered from said primary reactor separation means.

11. The process of claim 10 wherein said primary reactor is an isotropic pitch forming reactor comprising a tubular reactor operating at thermal polymerization conditions including a temperature above 600° F. and pressure above 500 psia.

12. The process of claim 10 wherein said primary reactor is a mesophase pitch forming reactor comprising a tubular reactor operating at mesophase formation conditions including a temperature above 600° F. and pressure below 500 psia.

13. The process of claim 10 wherein said contaminated feed is selected from the group of a slurry oil or clarified slurry oil from a fluidized catalytic cracking process, ethylene cracker bottoms, coal tar, wood tar and mixtures thereof.

14. The process of claim 10 wherein a minor portion of a contaminated fresh feed having alkyl groups on the aromatic rings is added to said vaporization purified intermediate.

15. The process of claim 14 wherein 1 to 25% contaminated fresh feed is added.

16. The process of claim 10 wherein said secondary reactor comprises two reactors in series, an isotropic pitch forming reactor operating at a pressure above 500 psia and temperature above 600° F. to produce a vaporization purified isotropic pitch product followed by a mesophase pitch forming reactor operating at a pressure below 500 psia and temperature above 600° F. to produce a vaporization purified mesophase pitch product.

17. The process of claim 16 wherein feed to said secondary reactor is 100% vaporization purified intermediate liquid product recovered from said primary reactor and primary vapor liquid separation means.

18. The process of claim 10 wherein said primary vapor liquid separation means is a cyclone separator.

19. The process of claim 10 wherein said secondary vapor liquid separation means is a cyclone separator.

* * * * *